US005624466A

United States Patent [19]

Schindler et al.

[11] Patent Number: 5,624,466

[45] Date of Patent: Apr. 29, 1997

[54] DYEING OF MELAMINE-FORMALDEHYDE CONDENSATION PRODUCTS

[75] Inventors: Wolfgang Schindler, Schwarzenbach a. d. Saale; Uwe Nahr, Dannstadt-Schauernheim, both of Germany

[73] Assignee: BASF Aktiengesellschaft, Ludwigshafen, Germany

[21] Appl. No.: 525,427

[22] Filed: Sep. 7, 1995

[30] Foreign Application Priority Data

Sep. 15, 1994 [DE] Germany ..... 44 32 833.8

[51] Int. Cl.[6] ..... D06P 1/16; D06P 1/18; D06P 1/19; D06P 1/20

[52] U.S. Cl. ..... 8/506; 8/520; 8/535; 8/662; 8/675

[58] Field of Search ..... 8/506, 520, 535, 8/662, 675

[56] References Cited

U.S. PATENT DOCUMENTS

| | | | |
|---|---|---|---|
| 2,461,612 | 2/1949 | Olypin et al. | 8/520 X |
| 4,009,995 | 3/1977 | Dressler | 8/506 X |
| 5,079,365 | 1/1992 | Sens et al. . | |
| 5,322,915 | 6/1994 | Weiser et al. . | |

FOREIGN PATENT DOCUMENTS

| | | |
|---|---|---|
| 0083553 | 7/1983 | European Pat. Off. . |
| 0201896 | 11/1986 | European Pat. Off. . |
| 0408947 | 1/1991 | European Pat. Off. . |
| WO92/19684 | 11/1992 | WIPO . |

OTHER PUBLICATIONS

The Chemistry of Synthetic Dyes, vol. VI, p. v, 1972, K. Venkataraman, "Reactive Dyes".

The Chemistry and Application of Dyes, pp. 107–118, 1990, L. Shuttleworth, et al., "Dyes for Polyester Fibers".

The Chemistry of Synthetic Dyes, vol. III, pp. vi–v, no month available 1970, K. Venkataraman.

The Chemistry of Synthetic Dyes, vol. II, pp. v–x, 1952, no month available K. Venkataraman.

*Primary Examiner*—Margaret Einsmann

*Attorney, Agent, or Firm*—Oblon, Spivak, McClelland, Maier & Neustadt, P.C.

[57] ABSTRACT

Condensation products obtainable by condensation of a mixture comprising unsubstituted melamine, substituted melamine and hydroxyphenyl compounds with formaldehyde or formaldehyde donor compounds are dyed in the form of fibers, yarns, threads, wovens, knits or nonwovens in an aqueous liquor with one or more dyes of the class of the azo, anthraquinone, coumarin, methine, azamethine, quinophthalone or nitro dyes.

8 Claims, No Drawings

DYEING OF MELAMINE-FORMALDEHYDE CONDENSATION PRODUCTS

The present invention relates to a novel process for dyeing textile condensation products obtainable by condensation of a mixture comprising unsubstituted melamine, substituted melamine and hydroxyphenyl compounds with formaldehyde or formaldehyde donor compounds in an aqueous liquor with a dye of the class of the azo, anthraquinone, coumarin, methine, azamethine, quinophthalone or nitro dyes.

U.S. Pat. No. 5,322,915 discloses specific condensation products based on melamine and formaldehyde. These condensation products can be used for manufacturing fire-resistant fibers, wovens, knits or nonwovens, for example fire-resistant suits.

It is an object of the present invention to provide a process whereby such condensation products can be dyed in an aqueous liquor with disperse or acid dyes in an advantageous manner. The condensation products shall be employed in textile form, ie. in the form of fibers, yarns, threads, wovens, knits or nonwovens.

We have found that this object is achieved by a process for dyeing condensation products obtainable by condensation of a mixture including as essential components (A) from 90 to 99.9 mol % of a mixture consisting essentially of (a) from 30 to 99 mol % of melamine and (b) from 1 to 70 mol % of a substituted melamine of the formula I

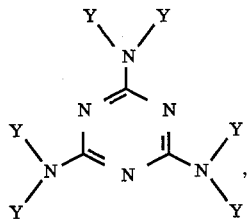

(I)

where each Y is independently of the others hydrogen, hydroxy-$C_2$–$C_{10}$-alkyl, hydroxy-$C_2$–$C_4$-alkyl-(oxa-$C_2$–$C_4$-alkyl)$_n$, where n is from 1 to 5, or amino-$C_2$–$C_{12}$-alkyl, with the proviso that at least one Y is not hydrogen, or mixtures of melamines of the formula I, and also (B) from 0.1 to 10 mol %, based on (A) plus (B), of phenol, which is optionally $C_1$–$C_9$-alkyl or hydroxy-substituted, $C_1$–$C_4$-alkanes which are hydroxyphenyl-substituted, bis(hydroxyphenyl) sulfones or mixtures thereof, with formaldehyde or formaldehyde donor compounds in a molar ratio of melamines to formaldehyde within the range from 1:1.15 to 1:4.5, which comprises treating the condensation products in the form of fibers, yarns, threads, wovens, knits or nonwovens in an aqueous liquor which has a pH from 1 to 12 at a temperature from 20° to 50° C. with one or more dyes of the class of the azo dyes, anthraquinone dyes, coumarin dyes, methine or azamethine dyes, quinophthalone dyes or nitro dyes.

As mentioned earlier, the production of the condensation products is described in U.S. Pat. No. 5,322,915, which is hereby expressly incorporated herein by reference.

The process of the present invention preferably makes use of those condensation products in which component (A) consists essentially of from 50 to 99 mol %, in particular from 85 to 95 mol % of melamine and of from 1 to 50 mol %, in particular from 5 to 15 mol %, of melamine of the formula I.

Preference is further given to using those condensation products which are obtainable by reacting components (A) and (B) with formaldehyde or formaldehyde donor compounds in a molar ratio of melamines to formaldehyde within the range from 1:1.8 to 1:3.0.

Y is for example hydroxy-$C_2$–$C_{10}$-alkyl, such as 2-hydroxyethyl, 3-hydroxypropyl, 2-hydroxyisopropyl, 4-hydroxybutyl, 5-hydroxypentyl, 6-hydroxyhexyl or 3-hydroxy-2,2-dimethylpropyl. Y is preferably hydroxy-$C_2$–$C_6$-alkyl, especially hydroxy-$C_2$–$C_4$-alkyl, very particularly preferably 2-hydroxyethyl or 2-hydroxyisopropyl.

Y may also be for example hydroxy-$C_2$–$C_4$-alkyl-(oxa-$C_2$–$C_4$-alkyl)$_n$, such as 5-hydroxy-3-oxapentyl, 5-hydroxy-3-oxa-2,5-dimethylpentyl, 5-hydroxy-3-oxa-1,4-dimethylpentyl, 5-hydroxy-3-oxa-1,2,4,5-tetramethylpentyl or 8-hydroxy-3,6-dioxaoctyl. n is preferably from 1 to 4, especially 1 or 2.

Y may further be for example amino-$C_2$–$C_{12}$-alkyl, such as 2-aminoethyl, 3-aminopropyl, 4-aminobutyl, 5-aminopentyl, 6-aminohexyl, 7-aminoheptyl or 8-aminooctyl. Y is preferably amino-$C_2$–$C_8$-alkyl, particularly preferably 2-aminoethyl or 6-aminohexyl, very particularly preferably 6-aminohexyl.

Suitable substituted melamines of the formula I include for example the following compounds: 2-hydroxyethylamino-1,3,5-triazines, such as 2-hydroxyethylamino-1,3,5-triazine, 2,4-bis (2-hydroxyethylamino) -1,3,5-triazine or 2,4,6-tris (2-hydroxyethylamino) -1,3,5-triazine, 2-Hydroxyisopropylamino-1,3,5-triazines, such as 2-(2-hydroxyisopropylamino)-1,3,5-triazine, 2,4-bis(2-hydroxyisopropylamino) -1,3,5-triazine or 2,4,6-tris (2-hydroxyisopropylamino) -1,3,5-triazine, 5-hydroxy-3-oxapentylamino-1,3,5-triazines, such as 2-(5-hydroxy-3-oxapentylamino)-1,3,5-triazine, 2,4-bis(5-hydroxy-3-oxapentylamino)-1,3,5-triazine or 2,4,6-tris (5-hydroxy-3-oxapentylamino)-1,3,5-triazine, or 6-aminohexylamino-1,3,5-triazines, such as 2-(6-aminohexylamino ) -1,3,5-triazine, 2,4-bis(6-aminohexylamino)-1,3,5-triazine or 2,4,6-tris (6-aminohexylamino) -1,3,5-triazine or mixtures thereof, for example a mixture of 10 mol % of 2-(5-hydroxy-3-oxapentylamino) -1,3,5-triazine, 50 mol % of 2,4-bis (5-hydroxy-3-oxapentylamino) -1,3,5-triazine and 40 mol % of 2,4,6-tris (5-hydroxy-3-oxapentylamino) -1,3,5-triazine.

Suitable compounds (B) include for example phenol, 4-methylphenol, 4-tert-butylphenol, 4-octylphenol, 4-nonylphenol, pyrocatechol, resorcinol, hydroquinone, 2,2-bis(4-hydroxyphenyl)propane or 4,4'-dihydroxydiphenyl sulfone. Preferred are phenol, resorcinol or 2,2-bis(4-hydroxyphenyl)propane.

Formaldehyde is generally used in the form of an aqueous solution having a concentration from for example 40 to 50% by weight or in the form of compounds which donate formaldehyde in the course of the reaction with (A) and (B), for example in the form of oligomeric or polymeric formaldehyde in solid form, such as paraformaldehyde, 1,3,5-trioxane or 1,3,5,7-tetroxocane.

The above-defined condensation products can be used in a conventional manner for producing fibers (e.g. EP-A-408 947).

The process of the present invention does of course also produce advantageous dyeings on blend fabrics of the above-specified condensation products with cellulose or aramid fibers, optionally by employing further dyestuff classes, e.g. reactive, vat, direct or sulfur dyes. Particularly suitable aramids consist essentially of a polycondensation product of iso- or terephthalic acid with a 45 meta- or para-phenylenediamine. Such products are known and commercially available for example from DuPont as Nomex® or Kevlar®.

The dyes employed in the process of the present invention come from the class of the azo, anthraquinone, coumarin, methine or azamethine, quinophthalone or nitro dyes. They either are free of ionic groups or carry carboxyl and/or sulfo groups.

Suitable dyes which are free of ionic groups will now be more particularly described.

Suitable azo dyes include in particular monoazo or disazo dyes, for example those with a diazo component derived from an aniline or from a five-membered aromatic heterocyclic amine which has from one to three hetero atoms selected from the group consisting of nitrogen, oxygen and sulfur in the heterocyclic ring and may be fused with a benzene, thiophene, pyridine or pyrimidine ring.

Important monoazo or disazo dyes include for example those whose diazo component is derived for example from aniline or from a heterocyclic amine of the pyrrole, furan, thiophene, pyrazole, imidazole, oxazole, isoxazole, thiazole, isothiazole, triazole, oxadiazole, thiadiazole, benzofuran, benzothiophene, benzimidazole, benzoxazole, benzothiazole, benzisothiazole, pyridothiophene, pyrimidothiophene, thienothiophene or thienothiazole series.

Of particular suitability are those diazo components which come from an aniline or from a heterocyclic amine of the pyrrole, thiophene, pyrazole, thiazole, isothiazole, triazole, thiadiazole, benzothiophene, benzothiazole, benzisothiazole, pyridothiophene, pyrimidothiophene, thienothiophene or thienothiazole series.

Also of importance are azo dyes with a coupling component of the aniline, aminonaphthalene, aminothiazole, diaminopyridine or hydroxypyridone series.

Of particular importance are azo dyes of the formula IIa $$D^1—N=N—K^1 \quad \text{(IIa)},$$

where $D^1$ is a radical of the formula

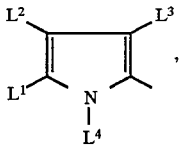
(IIIa)

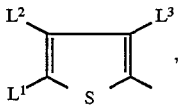
(IIIb)

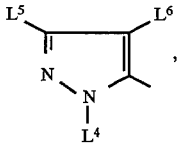
(IIIc)

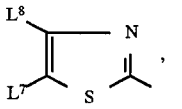
(IIId)

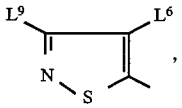
(IIIe)

-continued

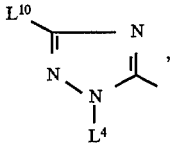
(IIIf)

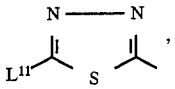
(IIIg)

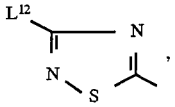
(IIIh)

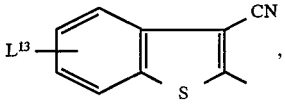
(IIIi)

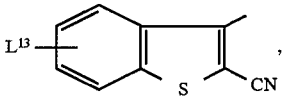
(IIIj)

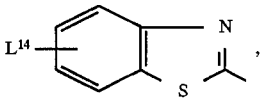
(IIIk)

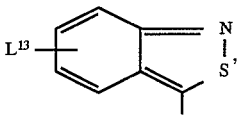
(IIIl)

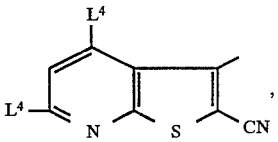
(IIIm)

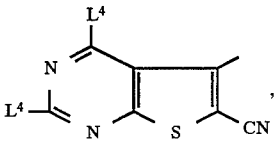
(IIIn)

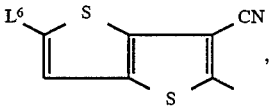
(IIIo)

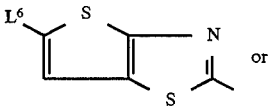
or
(IIIp)

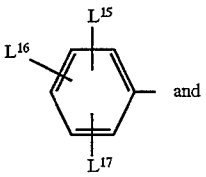
and
(IIIq)

K is hydroxyphenyl or a radical of the formula

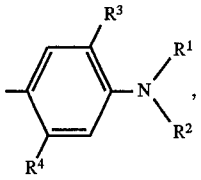

(IVa)

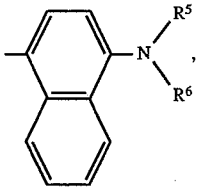

(IVb)

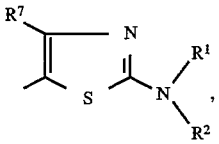

(IVc)

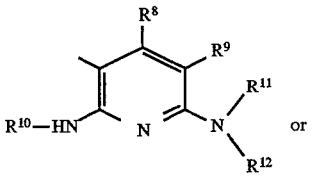

(IVd)

or

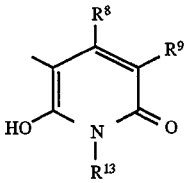

(IVe)

where $L^1$ is nitro, cyano, $C_1$–$C_6$-alkanoyl, benzoyl, $C_1$–$C_6$-alkylsulfonyl, substituted or unsubstituted phenylsulfonyl or a radical of the formula —CH=T, where T is hydroxyimino, $C_1$–$C_4$-alkoxyimino or a radical of an acidic-CH compound $H_2T$, $L^2$ is hydrogen, $C_1$–$C_6$-alkyl, halogen, hydroxyl, mercapto, unsubstituted or phenyl- or $C_1$–$C_4$-alkoxy-substituted $C_1$–$C_6$-alkoxy, substituted or unsubstituted phenoxy, unsubstituted or phenyl-substituted $C_1$–$C_6$-alkylthio, substituted or unsubstituted phenylthio, $C_1$–$C_6$-alkylsulfonyl or substituted or unsubstituted phenylsulfonyl, $L^3$ is cyano, $C_1$–$C_4$-alkoxycarbonyl or nitro, $L^4$ is hydrogen, $C_1$–$C_6$-alkyl or phenyl, $L^5$ is $C_1$–$C_6$-alkyl or phenyl, $L^6$ is hydrogen, cyano, $C_1$–$C_4$-alkoxycarbonyl, $C_1$–$C_6$-alkanoyl, thiocyanato or halogen, $L^7$ is nitro, cyano, $C_1$–$C_6$-alkanoyl, benzoyl, $C_1$–$C_4$-alkoxycarbonyl, $C_1$–$C_6$-alkylsulfonyl, substituted or unsubstituted phenylsulfonyl or a radical of the formula —CH=T, where T is as defined above, $L^8$ is hydrogen, $C_1$–$C_6$-alkyl, cyano, halogen, unsubstituted or phenyl- or $C_1$–$C_4$-alkoxy-substituted $C_1$–$C_6$-alkoxy, unsubstituted or phenyl-substituted $C_1$–$C_6$-alkylthio, substituted or unsubstituted phenylthio, $C_1$–$C_6$-alkylsulfonyl, substituted or unsubstituted phenylsulfonyl or $C_1$–$C_4$-alkoxycarbonyl, $L^9$ is cyano, unsubstituted or phenyl-substituted $C_1$–$C_6$-alkyl, unsubstituted or phenyl-substituted $C_1$–$C_6$-alkylthio, substituted or unsubstituted phenyl, thienyl, $C_1$–$C_4$-alkylthienyl, pyridyl or $C_1$–$C_4$-alkylpyridyl, $L^{10}$ is phenyl or pyridyl, $L^{11}$ is trifluoromethyl, nitro, $C_1$–$C_6$-alkyl, phenyl, unsubstituted or phenyl-substituted $C_1$–$C_6$-alkylthio or $C_1$–$C_6$-dialkylamino, $L^{12}$ is $C_1$–$C_6$-alkyl, phenyl, 2-cyanoethylthio or 2-($C_1$–$C_4$-alkoxycarbonyl)ethylthio, $L^{13}$ is hydrogen, nitro or halogen, $L^{14}$ is hydrogen, cyano, $C_1$–$C_4$-alkoxycarbonyl, nitro or halogen, $L^{15}$, $L^{16}$ and $L^{17}$ are identical or different and each is independently of the others hydrogen, $C_1$–$C_6$-alkyl, $C_1$–$C_6$-alkoxy, halogen, nitro, cyano, substituted or unsubstituted $C_1$–$C_4$-alkoxycarbonyl, $C_1$–$C_6$-alkylsulfonyl, substituted or unsubstituted phenylsulfonyl or substituted or unsubstituted phenylazo, $R^1$ and $R^2$ are each independently of the other hydrogen, substituted or unsubstituted $C_1$–$C_6$-alkyl, with or without interruption by 1 or 2 oxygen atoms in ether function, $C_5$–$C_7$-cycloalkyl or $C_3$–$C_6$-alkenyl, $R^3$ is hydrogen, $C_1$–$C_6$-alkyl or $C_1$–$C_6$-alkoxy, $R^4$ is hydrogen, $C_1$–$C_6$-alkyl, $C_1$–$C_6$-alkoxy, $C_1$–$C_6$-alkylsulfonylamino, substituted or unsubstituted $C_1$–$C_6$-alkanoylamino or benzoylamino, $R^5$ and $R^6$ are each independently of the other hydrogen or $C_1$–$C_6$-alkyl, $R^7$ is hydrogen, substituted or unsubstituted phenyl or thienyl, $R^8$ is hydrogen or $C_1$–$C_6$-alkyl, $R^9$ is cyano, carbamoyl or acetyl, $R^{10}$, $R^{11}$ and $R^{12}$ are identical or different and each is independently of the others substituted or unsubstituted $C_1$–$C_{12}$-alkyl, with or without interruption by 1 to 3 oxygen atoms in ether function, $C_5$–$C_7$-cycloalkyl, substituted or unsubstituted phenyl, $C_3$–$C_6$-alkenyl, substituted or unsubstituted benzoyl, $C_1$–$C_8$-alkanoyl, $C_1$–$C_6$-alkylsulfonyl or substituted or unsubstituted phenylsulfonyl, or $R^{11}$ and $R^{12}$ together with the nitrogen atom joining them together are a 5- or 6-membered saturated heterocyclic radical with or without further hetero atoms, and $R^{13}$ is hydrogen or $C_1$–$C_6$-alkyl.

Suitable anthraquinone dyes come for example from the class of the 1-aminoanthraquinones. They conform for example to the formula Va, Vb, Vc or Vd

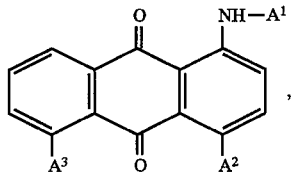

(Va)

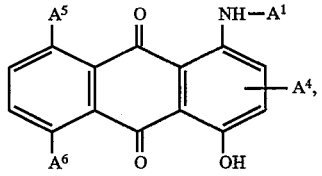

(Vb)

-continued

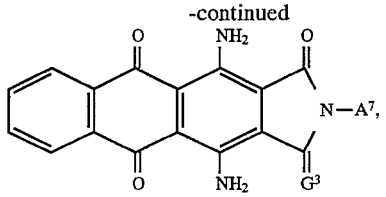

(Vc)

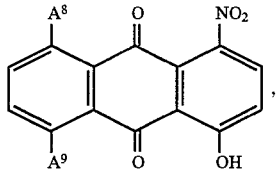

(Vd)

where $A^1$ is hydrogen, $C_1$–$C_8$-alkyl or substituted or unsubstituted phenyl, $A^2$ is hydroxyl or the radical NH—$A^1$, $A^3$ is hydrogen or nitro, A4 is halogen, hydroxyphenyl, $C_1$–$C_4$-alkoxyphenyl or a radical of the formula

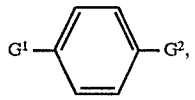

where $G^1$ is oxygen or sulfur and $G^2$ is hydrogen or $C_1$–$C_8$-monoalkylsulfamoyl whose alkyl chain may be interrupted by 1 or 2 oxygen atoms in ether function, one of the two radicals $A^5$ and $A^6$ is hydroxyl and the other is NH—$A^1$ or $A^5$ and $A^6$ are each hydrogen, $A^7$ is hydrogen or $C_1$–$C_8$-alkyl with or without interruption by from 1 to 3 oxygen atoms in ether function, one of the two radicals $A^8$ and $A^9$ is hydroxyl and the other is aniline, and $G^3$ is oxygen or imino.

Suitable coumarin dyes come for example from the class of the 7-dialkylaminocoumarins. They conform for example to the formula VIa, VIb or VIc

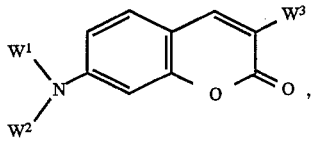

(VIa)

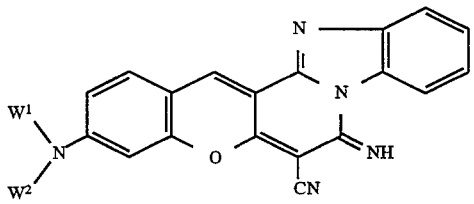

(VIb)

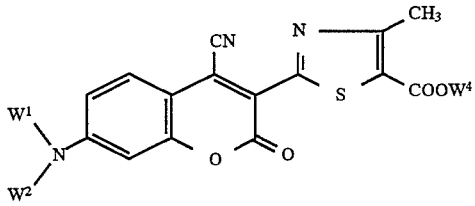

(VIc)

where $W^1$ and $W^2$ are independently of each other $C_1$–$C_4$-alkyl, $W^3$ is benzimidazol-2-yl, 5-chlorobenzoxazol-2-yl, benzothiazol-2-yl, 4-hydroxyquinazolin-2-yl or 5-phenyl-1,3,4-thiadiazol-2-yl, and $W^4$ is $C_1$–$C_8$-alkyl.

Suitable methine or azomethine dyes come for example from the class of the triazolopyridines or pyridines. They conform for example to the formula VIIa or VIIb

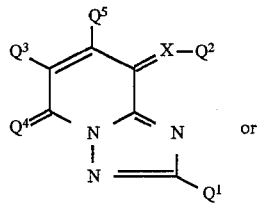

(VIIa)

or

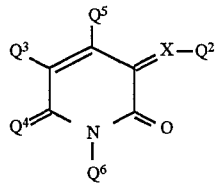

(VIIb)

where

X is nitrogen or CH, $Q^1$ is $C_1$–$C_{20}$-alkyl with or without substitution and with or without interruption by one or more oxygen atoms in ether function, substituted or unsubstituted phenyl or hydroxyl, $Q^2$ is a 5-membered aromatic heterocyclic radical, $Q^3$ is hydrogen, cyano, carbamoyl, carboxyl or $C_1$–$C_4$-alkoxycarbonyl, $Q^4$ is oxygen or a radical of the formula $C(CN)_2$, C(CN) $COOE^1$ or $C(COOE^1)_2$, where $E^1$ is in each case $C_1$–$C_8$-alkyl with or without interruption by 1 or 2 oxygen atoms in ether function, $Q^5$ is hydrogen or $C_1$–$C_4$-alkyl, $Q^6$ is $C_1$–$C_{20}$-alkyl with or without substitution and with or without interruption by one or more oxygen atoms in ether function, substituted or unsubstituted phenyl, hydroxyl or a radical of the formula $NE^2E^3$, where $E^2$ and $E^3$ are each independently of the other hydrogen, substituted or unsubstituted $C_1$–$C_{12}$-alkyl, $C_5$–$C_7$-cycloalkyl, substituted or unsubstituted phenyl, substituted or unsubstituted pyridyl, substituted or unsubstituted $C_1$–$C_{12}$-alkanoyl, $C_1$–$C_{12}$-alkoxycarbonyl, substituted or unsubstituted $C_1$–$C_{12}$-alkylsulfonyl, $C_5$–$C_7$-cycloalkylsulfonyl, substituted or unsubstituted phenylsulfonyl, substituted or unsubstituted pyridylsulfonyl, substituted or unsubstituted benzoyl, pyridylcarbonyl or thienylcarbonyl, or $E^2$ and $E^3$ together with the nitrogen atom joining them together are unsubstituted or $C_1$–$C_4$-alkyl-substituted succinimido, unsubstituted or $C_1$–$C_4$-alkyl-substituted phthalimido or a 5- or 6-membered saturated heterocyclic radical with or without further hetero atoms.

The dyes of the formula VIIa or VIIb can exist in a plurality of tautomeric forms which are all encompassed by the claims. For example, the compounds of the formula VIIa (where $Q^4$=oxygen and $Q^5$=methyl) can exist inter alia in the following tautomeric forms:

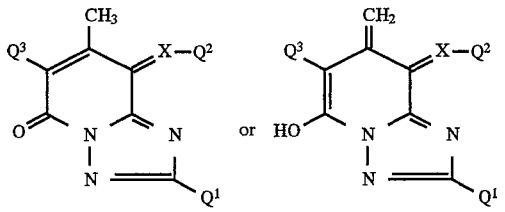

$Q^2$ can be derived for example from components of the pyrrole, thiazole, thiophene or indole series.

Important $Q^2$ radicals are for example those of the formulae VIIIa to VIIId

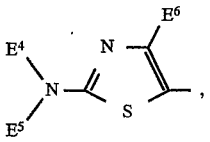

(VIIIa)

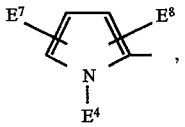

(VIIIb)

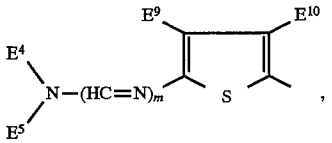

(VIIIc)

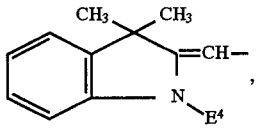

(VIIId)

where n is 0 or 1, $E^4$ and $E^5$ are each independently of the other hydrogen or else the abovementioned radical $R^1$, except for hydroxyl, or together with the nitrogen atom joining them together are a 5- or 6-membered saturated heterocyclic radical with or without further hetero atoms, $E^6$ is hydrogen, halogen, $C_1$–$C_8$-alkyl, unsubstituted or $C_1$–$C_4$-alkyl- or $C_1$–$C_4$-alkoxy-substituted phenyl, unsubstituted or $C_1$–$C_4$-alkyl- or $C_1$–$C_4$-alkoxy-substituted benzyl, cyclohexyl, thienyl, hydroxyl or mono-($C_1$–$C_8$-alkyl)amino, $E^7$ and $E^e$ are independently of each other hydrogen, hydroxyl, unsubstituted or phenyl- or $C_1$–$C_4$-alkylphenyl-substituted $C_1$–$C_8$-alkyl, unsubstituted or phenyl- or $C_1$–$C_4$-alkylphenyl-substituted $C_1$–$C_8$-alkoxy, $C_1$–$C_8$-alkanoylamino, $C_1$–$C_8$-alkylsulfonylamino or mono- or di($C_1$–$C_8$-alkyl) aminosulfonylamino, $E^9$ is cyano, carbamoyl, mono- or di($C_1$–$C_8$-alkyl) carbamoyl, $C_1$–$C_8$-alkoxycarbonyl or substituted or unsubstituted phenyl, and $E^{10}$ is halogen, hydrogen, $C_1$–$C_4$-alkyl, $C_1$–$C_4$-alkoxy, $C_1$–$C_4$-alkylthio, unsubstituted or $C_1$–$C_4$-alkyl- or $C_1$–$C_4$-alkoxy-substituted phenyl or thienyl.

Particularly suitable quinophthalone dyes have a quinoline ring which is either unsubstituted or halogen-substituted in ring position 4. They conform for example to the formula IX

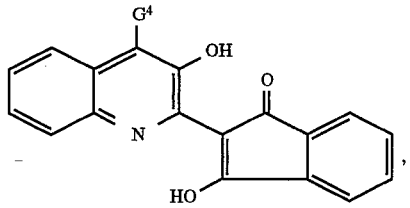

(IX)

where $G^4$ is hydrogen, chlorine or bromine.

A suitable nitro dye conforms for example to the formula X

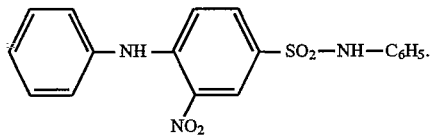

(X)

Any alkyl or alkenyl appearing in the abovementioned formulae may be straight-chain or branched.

Any substituted alkyl appearing in the abovementioned formulae may have as substituents for example, unless otherwise stated, cyclohexyl, phenyl, $C_1$–$C_4$-alkylphenyl, $C_1$–$C_4$-alkoxyphenyl, halophenyl, $C_1$–$C_4$-alkanoyloxy, $C_1$–$C_4$-alkylaminocarbonyloxy, $C_1$–$C_{20}$alkoxycarbonyl, $C_1$–$C_{20}$-alkoxycarbonyloxy, in which case the alkyl chain in the last three radicals mentioned may be interrupted by from 1 to 4 oxygen atoms in ether function and/or may be phenyl- or phenoxy-substituted, cyclohexyloxy, phenoxy, halogen, hydroxyl or cyano. The number of substituents in substituted alkyl is generally 1 or 2.

In any alkyl in the abovementioned formulae interrupted by oxygen atoms in ether function, the number of interrupting oxygen atoms in ether function, unless otherwise stated, is preferably from 1 to 4, especially 1 or 2.

Any substituted phenyl or pyridyl appearing in the abovementioned formulae may have as substituents for example, unless otherwise stated, $C_1$–$C_8$-alkyl, $C_1$–$C_8$-alkoxy, halogen, especially chlorine or bromine, nitro or carboxyl. The number of substituents in substituted phenyl or pyridyl is generally from 1 to 3.

Examples will now be mentioned of the radicals in the formulae II to V.

$L^2$, $L^4$, $L^5$, $L^8$, $L^9$, $L^{11}$, $L^{12}$, $L^{15}$, $L^{16}$, $L^{17}$, $R^1$, $R^2$, $R^3$, $R^4$, $R^5$, $R^6$, $R^8$, $R^{10}$, $R^{11}$, $R^{12}$ and $R^{13}$are each for example methyl, ethyl, propyl, isopropyl, butyl, isobutyl, sec-butyl, pentyl, isopentyl, neopentyl, tert-pentyl, hexyl or 2-methylpentyl.

$L^9$ may also be for example benzyl or 1- or 2-phenylethyl.

$L^2$, $L^8$, $L^9$ and $L^{11}$ may each also be for example methylthio, ethylthio, propylthio, isopropylthio, butylthio, isobutylthio, pentylthio, hexylthio, benzylthio or 1- or 2-phenylethylthio.

$L^2$ and $L^8$ may each also be for example phenylthio, 2-methylphenylthio, 2-methoxyphenylthio or 2-chlorophenylthio.

$L^2$, $L^8$, $L^{15}$, $L^{16}$, $L^{17}$, $R^3$ and $R^4$ may each also be for example methoxy, ethoxy, propoxy, isopropoxy, butoxy, isobutoxy, sec-butoxy, pentyloxy, isopentyloxy, neopentyloxy, tert-pentyloxy, hexyloxy or 2-methylpentyloxy.

$L^6$ is and each of $L^2$, $L^8$, $L^{13}$, $L^{14}$, $L^{15}$, $L^{16}$ and $L^{17}$ may further also be for example fluorine, chlorine or bromine.

$L^7$ is and each of $L^1$, $L^2$, $L^8$, $L^{15}$, $L^{16}$, $L^{17}$, $R^{10}$, $R^{11}$ and $R^{12}$ may further also be for example methylsulfonyl, ethylsulfonyl, propylsulfonyl, isopropylsulfonyl, butylsulfonyl, isobutylsulfonyl, sec-butylsulfonyl, pentylsulfonyl, isopentylsulfonyl, neopentylsulfonyl, hexylsulfonyl, phenylsulfonyl, 2-methylphenylsulfonyl, 2-methoxyphenylsulfonyl or 2-chlorophenylsulfonyl.

$L^3$ is and each of $L^6$, $L^7$, $L^8$, $L^{14}$, $L^{15}$, $L^{16}$ and $L^{17}$ may further also be for example methoxycarbonyl, ethoxycarbonyl, propoxycarbonyl, isopropoxycarbonyl, butoxycarbonyl, isobutoxycarbonyl or secbutoxycarbonyl.

$L^{15}$, $L^{16}$ and $L^{17}$ may each also be for example 2-phenoxyethoxycarbonyl, 2- or 3-phenoxypropoxycarbonyl, 2- or 4-phenoxybutoxycarbonyl, phenylazo, 4-nitrophenylazo or 2,4-dinitro-6-bromophenylazo.

$L^2$ and $L^8$ may each also be for example 2-methoxyethoxy, 2-ethoxyethoxy, 2- or 3-methoxypropoxy, 2- or 3-ethoxypropoxy, 2- or 4-methoxybutoxy, 2- or 4-ethoxybutoxy, 5-methoxypentyloxy, 5-ethoxypentyloxy, 6-methoxyhexyloxy, 6-ethoxyhexyloxy, benzyloxy or 1- or 2-phenylethoxy.

$L^{11}$ may also be for example dimethylamino, diethylamino, dipropylamino, diisopropylamino, dibutylamino, dipentylamino, dihexylamino or N-methyl-N-ethylamino.

$L^{12}$ may also be for example 2-methoxycarbonylethylthio or 2-ethoxycarbonylethylthio.

$R^1$, $R^2$, $R^{11}$, $R^{12}$ and $R^{13}$ may each also be for example cyclopentyl, cyclohexyl or cycloheptyl.

$L^9$ may also be for example phenyl, 2-, 3- or 4-methylphenyl, 2,4-dimethylphenyl, 2-, 3- or 4-methoxyphenyl, 2-, 3- or 4-chlorophenyl, 2- or 3-methylthienyl or 2-, 3- or 4-methylpyridyl.

$L^1$, $L^6$ and $L^7$ may each also be for example formyl, acetyl, propionyl, butyryl, pentanoyl or hexanoyl.

In a —CH=T radical $L^1$ or $L^7$ where T is derived from an acidic-CH compound $H_2T$ said acidic CH compounds $H_2T$ can for example be compounds of the formula

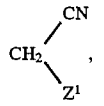
(XIa)

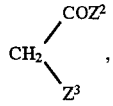
(XIb)

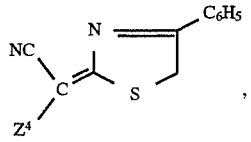
(XIc)

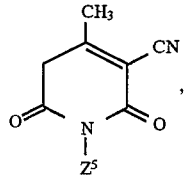
(IXId)

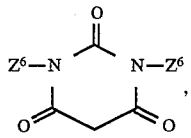
(XIe)

-continued

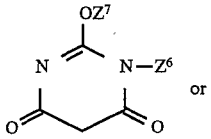
(XIf)

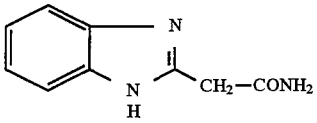
(XIg)

where $Z^1$ is cyano, nitro, $C_1$–$C_4$-alkanoyl, substituted or unsubstituted benzoyl, $C_1$–$C_4$-alkylsulfonyl, substituted or unsubstituted phenylsulfonyl, $C_1$–$C_4$-alkoxycarbonyl, $C_3$–$C_4$-alkenyloxycarbonyl, phenoxycarbonyl, carbamoyl, mono- or di($C_1$–$C_4$-alkyl)carbamoyl, substituted or unsubstituted phenylcarbamoyl, substituted or unsubstituted phenyl, 2-benzothiazolyl, 2-benzimidazolyl, 5-phenyl-1,3,4-thiadiazol-2-yl or 2-hydroxy-3-quinoxalinyl, $Z^2$ is $C_1$–$C_4$-alkyl, $C_1$–$C_4$-alkoxy or $C_3$–$C_4$-alkenyloxy, $Z^3$ is $C_1$–$C_4$-alkoxycarbonyl, $C_3$–$C_4$-alkenyloxycarbonyl, phenylcarbamoyl or 2-benzimidazolyl, $Z^4$ is cyano, $C_1$–$C_4$-alkoxycarbonyl or $C_3$–$C_4$-alkenyloxycarbonyl, $Z^5$ is hydrogen or $C_1$–$C_6$-alkyl, $Z^6$ is hydrogen, $C_1$–$C_4$-alkyl or phenyl, and $Z^7$ is $C_1$–$C_4$-alkyl.

Attention is drawn to the radical derived from compounds of the formula XIa, XIb or XIc where $Z^1$ is cyano, $C_1$–$C_4$-alkanoyl, $C_1$–$C_4$-alkoxycarbonyl or $C_3$–$C_4$-alkenyloxycarbonyl, $Z^2$ is $C_1$–$C_4$alkyl, $C_1$–$C_4$-alkoxy or $C_3$–$C_4$-alkenyloxy, $Z^3$ is $C_1$–$C_4$-alkoxycarbonyl or $C_3$–$C_4$-alkenyloxycarbonyl and $Z^4$ is cyano.

Particular attention is drawn to the radical derived from compounds of the formula XIa, XIb or XIc where $Z^1$ is cyano, $C_1$–$C_4$-alkoxycarbonyl or $C_3$–$C_4$-alkenyloxycarbonyl, $Z^2$ is $C_1$–$C_4$alkoxy or $C_2$–$C_4$-alkenyloxy, $Z^3$ is $C_1$–$C_4$-alkoxycarbonyl or $C_3$–$C_4$-alkenyloxycarbonyl and $Z^4$ is cyano.

$R^{10}$, $R^{11}$ and $R^{12}$ may each also be for example heptyl, octyl, 2-ethylhexyl, nonyl, decyl, undecyl, dodecyl, 4,7-dioxanonyl, 4,8-dioxadecyl, 4,6-dioxaundecyl, 3,6,9-trioxaundecyl, 4,7,10-trioxaundecyl or 4,7,10-trioxadodecyl.

$R^1$, $R^2$, $R^{10}$, $R^{11}$ and $R^{12}$ may each also be for example 2-methoxyethyl, 2-ethoxyethyl, 2-propoxyethyl, 2-butoxyethyl, 2-isobutoxyethyl, 2- or 3-methoxypropyl, 1-methoxyprop-2-yl, 2- or 3-ethoxypropyl or 2- or 3-propoxypropyl, 3,6-dioxaheptyl, 3,6-dioxaoctyl, 4,7-dioxaoctyl, 2-hydroxyethyl, 3-hydroxypropyl, 4-hydroxybutyl, 2-cyclohexyloxyethyl, 2- or 3-cyclohexyloxypropyl, 2- or 4-cyclohexyloxybutyl, 2-phenoxyethyl, 2-phenoxypropyl, 3-phenoxypropyl, 4-phenoxybutyl, 2-methoxycarbonylethyl, 2-ethoxycarbonylethyl, 2- or 3-methoxycarbonylpropyl, 2- or 3-ethoxycarbonylpropyl, 2- or 3-butoxycarbonylpropyl, 4-methoxycarbonylbutyl, 4-ethoxycarbonylbutyl, 2-cyanoethyl, 2- or 3-cyanopropyl, 4-cyanobutyl, 2-cyclohexylethyl, 2- or 3-cyclohexylpropyl, benzyl, 1- or 2-phenylethyl, 2-acetyloxyethyl, 2-propionyloxyethyl, 2- or 3-acetyloxypropyl, prop-2-en-1-yl, 2-methyl-prop-2-en-1-yl, but-2-en-1-yl or but-3-en-1-yl.

$R^{11}$ and $R^{12}$ combined with the nitrogen atom joining them together into a 5- or 6-membered saturated heterocyclic radical with or without further hetero atoms may be for example pyrrolidinyl, piperidinyl, morpholinyl, thiomorpholinyl, thiomorpholinyl S,S-dioxide, piperazinyl or N-($C_1$–$C_4$-alkyl)piperazinyl, such as N-methyl- or N-ethyl-piperazinyl.

$R^{10}$, $R^{11}$ and $R^{12}$ may each also be for example formyl, acetyl, propionyl, butyryl, isobutyryl, pentanoyl, hexanoyl, heptanoyl, octanoyl, 2-ethylhexanoyl, benzoyl, 2-, 3- or 4-methylbenzoyl, 2-, 3- or 4-methoxybenzoyl or 2-, 3- or 4-chlorobenzoyl.

Examples will now be mentioned of the radicals in the formulae Va to Vd.

$A^1$ and $A^7$ are each for example methyl, ethyl, propyl, isopropyl, butyl, isobutyl, sec-butyl, tert-butyl, pentyl, isopentyl, neopentyl, tert-pentyl, hexyl, 2-methylpentyl, heptyl, 1-ethylpentyl, octyl, 2-ethylhexyl or isooctyl.

$A^7$ may also be for example 2-methoxyethyl, 2-ethoxyethyl, 2-propoxyethyl, 2-isopropoxyethyl, 2-butoxyethyl, 2- or 3-methoxypropyl, 2- or 3-ethoxypropyl, 2- or 3-propoxypropyl, 2- or 3-butoxypropyl, 2- or 4-methoxybutyl, 2- or 4-ethoxybutyl, 2- or 4-propoxybutyl, 3,6-dioxaheptyl, 3,6-dioxaoctyl, 4,8-dioxanonyl, 3,7-dioxaoctyl, 3,7-dioxanonyl, 4,7-dioxaoctyl, 4,7-dioxanonyl, 2- or 4-butoxybutyl, 4,8-dioxadecyl, 3,6,9-trioxadecyl or 3,6,9-trioxaundecyl.

$A^1$ may also be for example phenyl, 2-, 3- or 4-methylphenyl, 2-, 3- or 4-ethylphenyl, 2-, 3- or 4-propylphenyl, 2-, 3- or 4-isopropylphenyl, 2-, 3- or 4-butylphenyl, 2,4-dimethylphenyl, 2-, 3- or 4-methoxyphenyl, 2-, 3- or 4-ethoxyphenyl, 2-, 3- or 4-isobutoxyphenyl or 2,4-dimethoxyphenyl.

$A^4$ is for example fluorine, chlorine, bromine, 2-, 3- or 4-methoxyphenyl or 2-, 3- or 4-ethoxyphenyl.

$G^2$ is for example methylsulfamoyl, ethylsulfamoyl, propylsulfamoyl, isopropylsulfamoyl, butylsulfamoyl, pentylsulfamoyl, hexylsulfamoyl, heptylsulfamoyl, octylsulfamoyl or 4-oxahexylsulfamoyl.

Examples will now be mentioned of the radicals in the formulae VIa to VIc.

and $W^4$ are each for example methyl, ethyl, propyl, isopropyl, butyl, isobutyl, sec-butyl or tert-butyl.

$W^4$ may also be for example pentyl, isopentyl, neopentyl, tert-pentyl, hexyl, 2-methylpentyl, heptyl, 1-ethylpentyl, octyl, 2-ethylhexyl or isooctyl.

Examples will now be mentioned of the radicals in the formulae VIIa and VIIb.

$Q^1$, $Q^5$, $Q^6$, $E^1$, $E^2$, $E^3$, $E^4$, $E^5$, $E^6$, $E^7$, $E^8$ and $E^{10}$ are each for example methyl, ethyl, propyl, isopropyl, butyl, isobutyl, sec-butyl or tert-butyl.

$Q^1$, $Q^6$, $E^1$, $E^2$, $E^3$, $E^4$, $E^5$, $E^6$, $E^7$ and $E^8$ may each also be for example pentyl, isopentyl, neopentyl, tert-pentyl, hexyl, 2-methylpentyl, heptyl, 1-ethylpentyl, octyl, 2-ethylhexyl or isooctyl.

$Q^1$, $E^2$ and $E^3$ may each also be for example nonyl, isononyl, decyl, isodecyl, undecyl or dodecyl.

$Q^1$ may also be for example tridecyl, isotridecyl, tetradecyl, pentadecyl, hexadecyl, heptadecyl, octadecyl, nonadecyl, eicosyl (the above designations isooctyl, isononyl, isodecyl and isotridecyl are trivial names derived from the oxo process alcohols cf. Ullmann's Enzyklopädie der technischen Chemie, 4th Edition, Volume 7, pages 215 to 217, and Volume 11, pages 435 and 436), 2-methoxycarbonylethyl, benzyl, 1- or 2-phenylethyl, 3-benzyloxypropyl, phenoxymethyl, 6-phenoxy-4-oxahexyl, 8-phenoxy-4-oxaoctyl, 2-, 3- or 4-chlorophenyl or 2-, 3- or 4-carboxyphenyl.

$Q^1$ and $E^1$ may each also be for example 2-methoxyethyl, 2-ethoxyethyl, 2-propoxyethyl, 2-isopropoxyethyl, 2-butoxyethyl, 2- or 3-methoxypropyl, 2- or 3-ethoxypropyl, 2- or 3-propoxypropyl, 2- or 3-butoxypropyl, 2- or 4-methoxybutyl, 2- or 4-ethoxybutyl, 2- or 4-propoxybutyl, 3,6-dioxaheptyl, 3,6-dioxaoctyl, 4,8-dioxanonyl, 3,7-dioxaoctyl, 3,7-dioxanonyl, 4,7-dioxaoctyl, 4,7-dioxanonyl, 2- or 4-butoxybutyl or 4,8-dioxadecyl.

$Q^1$ may also be for example 3,6,9-trioxadecyl, 3,6,9-trioxaundecyl, 3,6,9-trioxadodecyl, 3,6,9,12-tetraoxatridecyl, 3,6,9,12-tetraoxatetradecyl, 11-oxahexadecyl, 13-butyl-11-oxaheptadecyl or 4,11-dioxapentadecyl.

$Q^3$, $E^2$, $E^3$ and $E^9$ are each for example methoxycarbonyl, ethoxycarbonyl, propoxycarbonyl, isopropoxycarbonyl, butoxycarbonyl, isobutoxycarbonyl or sec-butoxycarbonyl.

$E^9$ may also be for example mono- or dimethylcarbamoyl, mono- or diethylcarbonyl, mono- or dipropylcarbamoyl, mono- or diisopropylcarbonyl, mono- or dibutylcarbamoyl or N-methyl-N-butylcarbamoyl.

$E^7$, $E^8$ and $E^{10}$ may each also be for example methoxy, ethoxy, propoxy, isopropoxy, butoxy, isobutoxy or sec-butoxy.

$E^{10}$ may also be for example methylthio, ethylthio, propylthio, isopropylthio, butylthio, isobutylthio or sec-butylthio.

$Q^1$, $E^2$, $E^3$ and $E^{10}$ may each also be for example phenyl, 2-, 3- or 4-methylphenyl, 2-, 3- or 4-ethylphenyl, 2-, 3- or 4-propylphenyl, 2-, 3- or 4-isopropylphenyl, 2-, 3- or 4-butylphenyl, 2,4-dimethylphenyl, 2-, 3- or 4-methoxyphenyl, 2-, 3- or 4-ethoxyphenyl, 2-, 3- or 4-isobutoxyphenyl or 2,4-dimethoxyphenyl.

$Q^1$, $E^2$ and $E^3$ may each also be for example 2-hydroxyethyl, 2- or 3-hydroxypropyl, 2-cyanoethyl, 2- or 3-cyanopropyl, 2-acetyloxyethyl, 2- or 3-acetyloxypropyl, 2-isobutyryloxyethyl, 2- or 3-isobutyryloxypropyl, 2-methoxycarbonylethyl, 2- or 3-methoxycarbonylpropyl, 2-ethoxycarbonylethyl, 2- or 3-ethoxycarbonylpropyl, 2-methoxycarbonyloxyethyl, 2- or 3-methoxycarbonyloxypropyl, 2-ethoxycarbonyloxyethyl, 2- or 3-ethoxycarbonyloxypropyl, 2-butoxycarbonyloxyethyl, 2- or 3-butoxycarbonyloxypropyl, 2-(2-phenylethoxycarbonyloxy)ethyl, 2- or 3-(2-phenylethoxycarbonyloxy)propyl, 2-(2-ethoxyethoxycarbonyloxy)ethyl or 2- or 3-(2-ethoxyethoxycarbonyloxy)propyl.

$E^2$ and $E^3$ may each also be for example pyridyl, 2-, 3- or 4-methylpyridyl, 2-, 3- or 4-methoxypyridyl, formyl, acetyl, propionyl, butyryl, isobutyryl, pentanoyl, hexanoyl, heptanoyl, octanoyl, 2-ethylhexanoyl, methylsulfonyl, ethylsulfonyl, propylsulfonyl, isopropylsulfonyl, butylsulfonyl, cyclopentylsulfonyl, cyclohexylsulfonyl, cycloheptylsulfonyl, phenylsulfonyl, tolylsulfonyl, pyridylsulfonyl, benzoyl, 2-, 3- or 4-methylbenzoyl, 2-, 3- or 4-methoxybenzoyl, thien-2-ylcarbonyl, thien-3-yl-carbonyl, cyclopentyl, cyclohexyl or cycloheptyl.

$E^2$ and $E^3$ or $E^4$ and $E^5$ combined with the nitrogen atom joining them together into a 5- or 6-membered saturated heterocyclic radical with or without further hetero atoms may be for example pyrrolidinyl, piperidinyl, morpholinyl, piperazinyl, thiomorpholinyl, thiomorpholinyl 5,5-dioxide or N-($C_1$–$C_4$alkyl)piperazinyl, such as N-methyl- or N-ethyl-piperazinyl.

Particularly suitable monoazo dyes are those of the formula IIa where $D^1$ is a radical of the formula IIIb.

Particularly suitable monoazo dyes further include those of the formula IIa where $K^1$ is a radical of the formula IVa or IVd.

Particular attention is drawn to monoazo dyes of the formula IIb

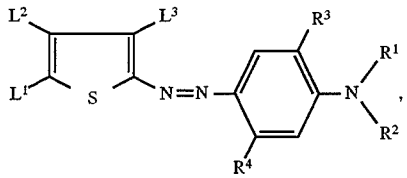

(IIb)

where $L^1$ is nitro, cyano, $C_1$–$C_6$-alkanoyl or a radical of the formula —CH=T where T is a radical of an acidic-CH compound $H_2T$, $L^2$ is $C_1$–$C_6$-alkyl, halogen, unsubstituted or phenyl- or $C_1$–$C_4$-alkoxy-substituted $C_1$–$C_6$-alkoxy, $L^3$ is cyano, $C_1$–$C_4$-alkoxycarbonyl or nitro, $R^1$and $R^2$ are independently of each other hydrogen, substituted or unsubstituted $C_1$–$C_6$-alkyl with or without interruption by 1 or 2 oxygen atoms in ether function, or $C_3$–$C_6$-alkenyl, $R^3$ is hydrogen, $C_1$–$C_6$-alkyl or $C_1$–$C_6$-alkoxy, and $R^4$ is hydrogen, $C_1$–$C_6$-alkyl, $C_1$–$C_6$-alkoxy, $C_1$–$C_6$-alkylsulfonylamino or substituted or unsubstituted $C_1$–$C_6$-alkanoylamino.

Particularly suitable methine or azamethine dyes conform to the formula VIIa or VIIb where $R^5$ is methyl.

Particularly suitable methine or azamethine dyes further conform to the formula VIIa or VIIb where $Q^5$ is cyano.

Particularly suitable methine or azamethine dyes further conform to the formula VIIa or VIIb where $Q^4$ is oxygen.

Particularly suitable azamethine dyes further conform to the formula VII where X is nitrogen.

Particularly suitable methine dyes further conform to the formula VII where X is CH.

Particularly suitable methine or azamethine dyes further conform to the formula VIIa or VIIb where $Q^2$ is a radical of the pyrrole, thiazole or thiophene series.

Particularly suitable methine or azamethine dyes further conform to the formula VIIa where $Q^1$ is $C_1$–$C_{12}$-alkyl with or without substitution by $C_1$–$C_6$-alkanoyloxy, $C_1$–$C_8$-alkoxycarbonyl, whose alkyl chain may be interrupted by 1 or 2 oxygen atoms in ether function, phenyl or $C_1$–$C_4$-alkylphenyl and with or without interruption by 1 or 2 oxygen atoms in ether function.

Particularly suitable methine or azamethine dyes further conform to the formula VIIb where $Q^6$ is a radical of the formula $NE^2E^3$ where $E^2$ and $E^3$ are independently of each other substituted or unsubstituted $C_1$–$C_{12}$-alkanoyl or substituted or unsubstituted benzoyl or else $E^2$ is hydrogen.

Particular attention is drawn to methine or azamethine dyes of the formula VIIb where $Q^6$ is a radical of the formula $NE^2E^3$ where $E^2$ and $E^3$ are independently of each other $C_1$–$C_8$-alkanoyl or benzoyl or else $E^2$ is hydrogen.

Particular attention is further drawn to methine or azamethine dyes of the formula VIIa where $Q^1$ is alkyl, alkoxyalkyl, alkanoyloxyalkyl or alkoxycarbonylalkyl, which radicals may have up to 12 carbon atoms each, unsubstituted or methyl-substituted benzyl or unsubstituted or methyl-substituted phenyl.

Particular attention is further drawn to methine or azamethine dyes of the formula VIIa or VIIb where $Q^2$ is a radical of the abovementioned formula VIIIa or VIIIc, especially VIIIa, where $E^4$ and $E^5$ are independently of each other alkyl, alkoxyalkyl, alkanoyloxyalkyl or alkoxycarbonylalkyl, which radicals may have up to 12 carbon atoms each, hydrogen, unsubstituted or ethyl-substituted benzyl or unsubstituted or methyl-substituted phenyl, $E^6$ is hydrogen, $C_1$–$C_4$-alkyl, unsubstituted or $C_1$–$C_4$-alkyl- or $C_1$–$C_4$-alkoxy-substituted phenyl, benzyl or thienyl, $E^9$ is cyano, $E^{10}$ is halogen, hydrogen, $C_1$–$C_4$-alkyl, $C_1$–$C_4$-alkoxy, $C_1$–$C_4$-alkylthio, unsubstituted or $C_1$–$C_4$-alkyl-substituted phenyl or thienyl, and n is 0.

Particularly suitable quinophthalone dyes conform to the formula IX where $G^4$ is hydrogen or bromine.

The monoazo dyes of the formula IIa are known per se and have been described in large numbers, for example in K. Venkataraman, The Chemistry of Synthetic Dyes, Vol. VI, Academic Press, New York, London, 1972, or EP-A-201 896.

The anthraquinone dyes of the formula Va to Vc are likewise known per se and described for example in D. R. Waring, G. Hallas, The Chemistry and Application of Dyes, pages 107 to 118, Plenum Press, New York, London, 1990.

The coumarin dyes of the formula VIa to VIc are likewise known per se and described for example in Ullmann's Enzyklopädie der technischen Chemie, 4th Edition, Volume 17, page 469.

The methine or azamethine dyes of the formula VIIa and VIIb are likewise known per se and described for example in U.S. Pat. No. 5 079 365 and WO-A-92/19684.

The quinophthalone dyes of the formula IX are likewise known per se and described for example in EP-83 553.

The nitro dye of the formula X is commonly referred to as C.I. Disperse Yellow 42 (10 338).

Suitable dyes with carboxyl and/or sulfo groups will now be more particularly described. These dyes are in particular azo or anthraquinone dyes.

Of azo dyes, it is monoazo or disazo dyes, which may also be metallized, which are notable, in particular those which have from 1 to 6 carboxyl and/or sulfo groups.

Important azo dyes are for example those whose diazo component is derived from an aniline or aminonaphthalene.

Important azo dyes further include for example those whose coupling component is derived from an aniline, naphthalene, pyrazolone, aminopyrazole, diaminopyridine, pyridone or acylacetarylide.

Specific examples include metal-free or metallized (metal complexes) azo dyes of the phenyl-azo-naphthalene, phenyl-azo-1-phenylpyrazol-5-one, phenyl-azo-benzene, naphthyl-azo-benzene, phenyl-azo-aminonaphthalene, naphthyl-azo-naphthalene, naphthyl-azo-1-phenylpyrazol-5-one, phenyl-azo-pyridone, phenyl-azo-aminopyridine, naphthyl-azo-pyridone, naphthyl-azo-aminopyridine or stilbyl-azo-benzene series.

The azo dyes may additionally contain a reactive group, for example the radical of the formula

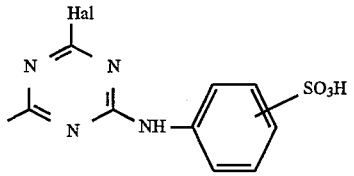

which is linked either to the diazo component or to the coupling component via a substituted or unsubstituted amino group.

Of particular importance are azo dyes of the formula IIc $D^2$—N=N—$K^2$ (IIc), where $D^2$ is a radical of the formula
(XIIa)
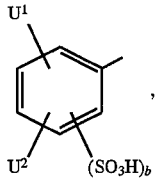
(XIIb)
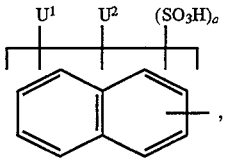
(XIIc)
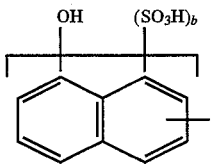
(XIId)
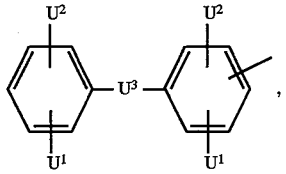
(XIIe)
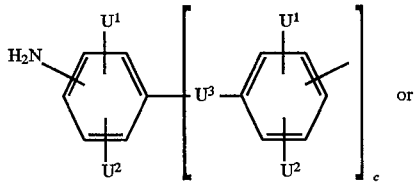
or
(XIIf)
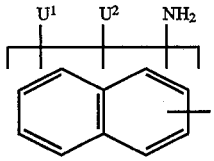
and
$K^2$ is a radical of the formula
(XIIIa)
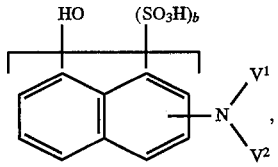
(XIIIb)
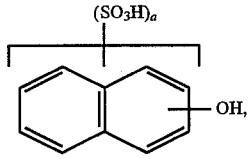
(XIIIc)
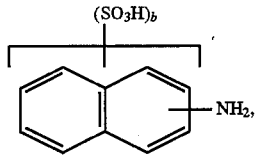
-continued
(XIIId)
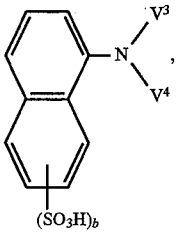
(XIIIe)
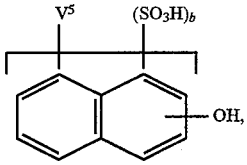
(XIIIf)
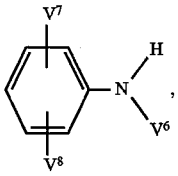
(XIIIg)
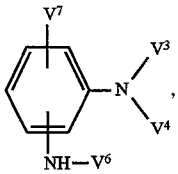
(XIIIh)
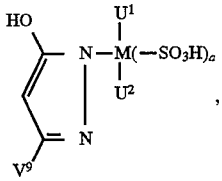
(XIIIi)
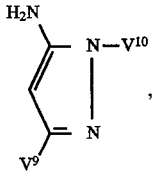
(XIIIj)
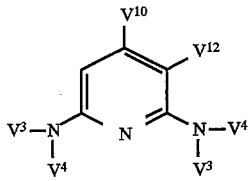
(XIIIk)
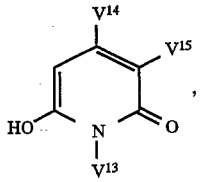

-continued

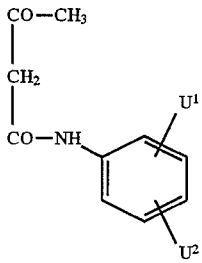

(XIII)

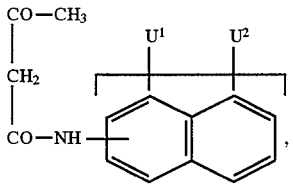

(XIIIm)

where a is 0, 1, 2 or 3, b is 0, 1 or 2, c is 0 or 1, $U^1$ is hydrogen, methyl, ethyl, methoxy, ethoxy, acetyl, cyano, carboxyl, hydroxysulfonyl, $C_1$–$C_4$-alkoxycarbonyl, hydroxyl, carbamoyl, $C_1$–$C_4$-monoalkylcarbamoyl or -dialkylcarbamoyl, fluorine, chlorine, bromine or trifluoromethyl, $U^2$ is hydrogen, methyl, ethyl, methoxy, ethoxy, cyano, carboxyl, hydroxysulfonyl, acetylamino, $C_1$–$C_4$-alkoxycarbonyl, carbamoyl, $C_1$–$C_4$-monoalkylcarbamoyl or -dialkylcarbamoyl, fluorine, chlorine, nitro, sulfamoyl, $C_1$–$C_4$-monoalkylsulfamoyl or -dialkylsulfamoyl, $C_1$–$C_4$-alkylsulfonyl, phenylsulfonyl or phenoxy, and $U^3$ is a direct bond, oxygen, sulfur or the group —NHCO—, NH—CO—NH—, —CONH—, —CO—, —$NHSO_2$—, —$SO_2NH$—, —$SO_2$—, —CH=CH—, —$CH_2$—$CH_2$—, —$CH_2$—, —NH—, or —N=N—, $V^1$ is hydrogen or $C_1$–$C_4$-alkyl, $V^2$ is hydrogen, $C_1$–$C_4$-alkyl or phenyl which may be monosubstituted or disubstituted by $C_1$–$C_5$-alkyl, $C_1$–$C_4$-alkoxy, chlorine, bromine or hydroxysulfonyl, $V^3$ is hydrogen or $C_1$–$C_4$-alkyl which may be substituted by hydroxyl, cyano, carboxyl, hydroxysulfonyl, sulfato, methoxycarbonyl, ethoxycarbonyl or acetoxy, $V^4$ is hydrogen, $C_1$–$C_4$-alkyl which may be hydroxyl-, cyano-, carboxyl-, hydroxysulfonyl-, sulfato-, methoxycarbonyl-, ethoxycarbonyl- or acetoxy-substituted, benzyl or phenyl which may be substituted by $C_1$–$C_4$-alkyl, $C_1$–$C_4$-alkoxy, chlorine or hydroxysulfonyl, $V^5$ is $C_1$–$C_6$-alkylureido, phenylureido, which may be chlorine-, methyl-, methoxy--, nitro--, hydroxysulfonyl-- or carboxyl-substituted, $C_1$–$C_6$-alkanoylamino, which may be hydroxysulfonyl- or chlorine- substituted, cyclohexanoylamino, benzoylamino, which may be chlorine-, methyl-, methoxy-, nitro-, hydroxylsulfonyl- or carboxyl-substituted, or hydroxyl, $V^6$ is hydrogen, $C_1$–$C_6$-alkyl, which may be phenyl-, $C_1$–$C_4$-alkoxy-, hydroxyl-, phenoxy- or $C_1$–$C_4$-alkanoyloxy-substituted, $C_5$–$C_7$-cycloalkyl, hydroxysulfonylphenyl, $C_1$–$C_4$-alkanoyl, carbamoyl, $C_1$–$C_4$-monoalkylcarbamoyl or -dialkylcarbamoyl, phenylcarbamoyl or cyclohexylcarbamoyl, $V^7$ is methoxy, ethoxy, chlorine, bromine, hydroxysulfonyl, acetylamino, amino, ureido, methylsulfonylamino, ethylsulfonylamino, dimethylaminosulfonylamino, methylamino, ethylamino, dimethylamino or diethylamino, $V^8$ is hydrogen, methyl, ethyl, methoxy, ethoxy, hydroxysulfonyl, chlorine or bromine, M is the radical of a benzene or naphthalene nucleus, $V^9$ is methyl, carboxyl, $C_1$–$C_4$-alkoxycarbonyl or phenyl, $V^{10}$ $C_1$–$C_4$-alkyl, cyclohexyl, benzyl or phenyl which may be substituted by fluorine, chlorine, bromine, methyl, methoxy, nitro, hydroxysulfonyl, carboxyl, acetyl, acetylamino, methylsulfonyl, sulfamoyl or carbamoyl, $V^{11}$ is hydrogen or $C_1$–$C_4$-alkyl which may be substituted by methoxy, ethoxy or cyano, $V^{12}$ is hydrogen, methyl, hydroxysulfonylmethyl, hydroxysulfonyl, cyano or carbamoyl, $V^{13}$ is hydrogen, C–$C_4$-alkyl which may be phenyl-, hydroxysulfonylphenyl-, hydroxyl-, amino-, methoxy-, ethoxy-, carboxyl-, hydroxysulfonyl-, acetylamino-, benzoylamino-or cyano-substituted, cyclohexyl, phenyl which may be carboxyl-, hydroxysulfonyl-, benzoylamino-, acetylamino-, methyl-, methoxy-, cyano- or chlorine-substituted, or amino which is substituted by phenyl, $C_1$–$C_4$-alkyl, acetyl or benzoyl, $V^{14}$ is $C_1$–$C_4$-alkyl, phenyl, hydroxyl, cyano, acetyl, benzoyl, carboxyl, methoxycarbonyl, carbamoyl or hydroxysulfonylmethyl and $V^{15}$ is hydrogen, chlorine, bromine, acetylamino, amino, nitro, hydroxysulfonyl, sulfamoyl, methylsulfonyl, phenylsulfonyl, carboxyl, methoxycarbonyl, acetyl, benzoyl, carbamoyl, cyano or hydroxysulfonylmethyl, with the proviso that at least one carboxyl and/or sulfo group is present in the molecule.

Aromatic amines which are suitable for use as diazo components and which are derived from the formula XIIa, XIIb, XIIc or XIId are for example aniline, 2-methoxyaniline, 2-methylaniline, 4-chloro-2-aminoanisole, 4-methylaniline, 4-methoxyaniline, 2-methoxy-5-methylaniline, 2,5-dimethoxyaniline, 2,5-dimethylaniline, 2,4-dimethylaniline, 2,5-diethoxyaniline, 2-chloroaniline, 3-chloroaniline, 4-chloroaniline, 2,5-dichloroaniline, 4-chloro-2-nitroaniline, 4-chloro-2-methylaniline, 3-chloro-2-methylaniline, 4-chloro-2-aminotoluene, 4-phenylsulfonylaniline, 2-ethoxy-1-naphthylamine, 1-naphthylamine, 2-naphthylamine, 4-methylsulfonylaniline, 2,4-dichloroaniline-5-carboxylic acid, 2-aminobenzoic acid, 4-aminobenzoic acid, 3-aminobenzoic acid, 25 3-chloroaniline-6-carboxylic acid, aniline-2- or -3- or -4-sulfonic acid, aniline-2,5-disulfonic acid, aniline-2,4-disulfonic acid, aniline-3,5-disulfonic acid, 2-aminotoluene-4-sulfonic acid, 2-aminoanisole-5-sulfonic acid, 2-ethoxyaniline-5-sulfonic acid, 2-ethoxyaniline-4-sulfonic acid, 4-hydroxysulfonyl-2-aminobenzoic acid, 2,5-dimethoxyaniline-4-sulfonic acid, 2,4-dimethoxyaniline-5-sulfonic acid, 2-methoxy-5-methylaniline-4-sulfonic acid, 4-aminoanisole-3-sulfonic acid, 4-aminotoluene-3-sulfonic acid, 2-aminotoluene-5-sulfonic acid, 2-chloroaniline-4-sulfonic acid, 2-chloroaniline-5-sulfonic acid, 2-bromoaniline-4-sulfonic acid, 2,6-dichloroaniline-4-sulfonic acid, 2,6-dimethylaniline-3- or -4-sulfonic acid, 3-acetylaminoaniline-6-sulfonic acid, 4-acetylaminoaniline-2-sulfonic acid, 1-aminonaphthalene-3-sulfonic acid, 1-aminonaphthalene-4-sulfonic acid, 1-aminonaphthalene-5-sulfonic acid, 1-aminonaphthalene-6-sulfonic acid, 1-aminonaphthalene-7-sulfonic acid, 1-aminonaphthalene-3,7-disulfonic acid, 1-aminonaphthalene-3,6,8-trisulfonic acid, 1-aminonaphthalene-4,6,8-trisulfonic acid, 2-aminonaphthalene-5-, -6- or -8-sulfonic acid, 2-aminonaphthalene-3,6,8-trisulfonic acid, 2-aminonaphthalene-6,8-disulfonic acid, 2-aminonaphthalene-1,6-disulfonic acid, 2-aminonaphthalene-1-sulfonic acid, 2-aminonaphthalene-1,5-disulfonic acid, 2-aminonaphthalene-3,6-disulfonic acid, 2-aminonaphthalene-4,8-disulfonic acid, 2-aminophenol-4-sulfonic acid, 2-aminophenol-5-sulfonic acid, 3-aminophenol-6-sulfonic acid, 1-hydroxy-2-aminonaphthalene-5,8- or -4,6-disulfonic acid, 4-aminodiphenylamine, 4-amino-4'-methoxydiphenylamine, 4-amino-4'-methoxydiphenylamine-3- sulfonic acid, 4-(2'-methylphenylazo)-2-methylaniline, 4-amino-azobenzene, 4'-nitrophenylazo-1-aminonaphthalene, 4-(6'-hydroxysulfonylnaphthylazo)-1-aminonaphthalene, 4-(2',5'-dihydroxysulfonylphenylazo)-1-aminonaphthalene, 4'-amino-3'-methyl-3-nitrobenzophenone, 4-aminobenzophenone, 4-(4'-aminophenylazo) benzenesulfonic acid, 4-(4'-amino-2'-methoxyphenylazo) benzenesulfonic acid, 4-(4'-amino-3'-methoxyphenylazo) benzenesulfonic acid and 2-ethoxy-1-naphthylamine-6-sulfonic acid.

Aromatic diamines which are suitable for use as tetrazo components and which are derived from the formula XIIe or XIIf are for example 1,3-diaminobenzene, 1,3-diaminobenzene-4-sulfonic acid, 1,4-diaminobenzene, 1,4-diaminobenzene-2-sulfonic acid, 1,4-diamino-2-methylbenzene, 1,4-diamino-2-methoxybenzene, 1,3-diamino-4-methylbenzene, 1,3-diaminobenzene-5-sulfonic acid, 1,3-diamino-5-methylbenzene, 1,6-diaminonaphthalene-4-sulfonic acid, 2,6-diaminonaphthalene-4,8-disulfonic acid, 3,3'-diaminodiphenyl sulfone, 4,4'-diaminodiphenyl sulfone, 4,4'-diaminostilbene-2,2'-disulfonic acid, 2,7'-diaminodiphenyl sulfone, 2,7'-diaminodiphenyl sulfone-4,5-disulfonic acid, 4,4'-diaminobenzophenone, 4,4'-diamino-3,3'-dinitrobenzophenone, 3,3'-diamino-4,4'-dichlorobenzophenone, 4,4'- or 3,3'-diaminobiphenyl, 4,4'-diamino-3,3'-dichlorobiphenyl, 4,4'-diamino-3,3'-dimethoxy- or -3,3'-dimethyl- or -2,2'-dimethyl- or -2,2'-dichloro- or -3,3'-diethoxybiphenyl, 4,4'-diamino-3,3'-dimethyl-6,6'-dinitrobiphenyl, 4,4'-diaminobiphenyl-2,2'- or -3,3'-disulfonic acid, 4,4'-diamino-3,3'-dimethyl- or -3,3'-dimethoxy- or -2,2'-dimethoxybiphenyl-6,6'-disulfonic acid, 4,4'-diamino-2,2', 5,5'-tetrachlorobiphenyl, 4,4'-diamino-3,3'-dinitrobiphenyl, 4,4'-diamino-2,2'-dichloro-5,5'-dimethoxybiphenyl, 4,4'-diaminobiphenyl-2,2'- or -3,3'-dicarboxylic acid, 4,4'-diamino-3,3'-di- methylbiphenyl-5,5'-disulfonic acid, 4,4'-diamino-2-nitrobiphenyl, 4,4'-diamino-3-ethoxy- or -3-hydroxysulfonylbiphenyl, 4,4'-diamino-3,3'-dimethylbiphenyl-5-sulfonic acid, 4,4'-diaminodiphenylmethane, 4,4'-diamino-3,3'-dimethyldiphenylmethane, 40 4,4'-diamino-2,2', 3,3'-tetramethyldiphenylmethane, 4,4'-diaminodiphenylethane, 4,4'-diaminostilbene or 4,4'-diaminodiphenylmethane-3,3'-dicarboxylic acid.

$K^2$ is for example an aniline, such as o- or m-toluidine, o- or m-anisidine, cresidine, 2,5-dimethylaniline, 2,5-dimethoxyaniline, m-aminoacetanilide, 3-amino-4-methoxyacetanilide, 3-amino-4-methylacetanilide, m-aminophenylurea, N-methylaniline, N-methyl-m-toluidine, N-ethylaniline, N-ethyl-m-toluidine, N-(2-hydroxyethyl ) aniline or N-(2-hydroxyethyl ) -m-toluidine.

$K^2$ may also be for example a naphtholsulfonic acid, such as 1-naphthol-3-sulfonic acid, 1-naphthol-4-sulfonic acid, 1-naphthol-5-sulfonic acid, 1-naphthol-8-sulfonic acid, 1-naphthol-3,6-disulfonic acid, 1-naphthol-3,8-disulfonic acid, 2-naphthol-5-sulfonic acid, 2-naphthol-6-sulfonic acid, 2-naphthol-7-sulfonic acid, 2-naphthol-8-sulfonic acid, 2-naphthol-3,6-disulfonic acid, 2-naphthol-6,8-disulfonic acid, 2-naphthol-3,6,8-trisulfonic acid, 1,8-dihydroxynaphthalene-3,6-disulfonic acid, 2,6-dihydroxynaphthalene-8-sulfonic acid or 2,8-dihydroxynaphthalene-6-sulfonic acid.

$K^2$ may also be for example a naphthylamine or a naphthol, such as 1-naphthylamine, N-phenyl-1-naphthylamine, N-ethyl-1-naphthylamine, N-phenyl-2-naphthylamine, 1-naphthol, 2-naphthol, 1,5-dihydroxynaphthalene, 1,6-dihydroxynaphthalene, 1,7-dihydroxynaphthalene or 2,7-dihydroxynaphthalene.

$K^2$ may also be for example an aminonaphthalenesulfonic acid, such as 1-naphthylamine-6-sulfonic acid, 1-naphthylamine-7-sulfonic acid, 1-naphthylamine-8-sulfonic acid, 2-naphthylamine-3,6-disulfonic acid, 2-naphthylamine-5,7-disulfonic acid or 2-naphthylamine-6,8-disulfonic acid.

$K^2$ may also be for example an aminonaphtholsulfonic acid, such as 1-amino-5-hydroxynaphthalene-7-sulfonic acid, 1-amino-8-hydroxynaphthalene-4-sulfonic acid, 1-amino-8-hydroxynaphthalene-2,4-disulfonic acid, 1-amino-8-hydroxynaphthalene-3,6-disulfonic acid, 1-amino-8-hydroxynaphthalene-4,6-disulfonic acid, 2-amino-5-hydroxynaphthalene-7-sulfonic acid, 2-amino-8-hydroxynaphthalene-6-sulfonic acid, 2-amino-8-hydroxynaphthalene-3,6-disulfonic acid, 2-amino-5-hydroxynaphthalene-1,7-disulfonic acid, 1-acetylamino-8-hydroxynaphthalene-3,6-disulfonic acid, 1-benzoylamino-8-hydroxynaphthalene-3,6-disulfonic acid, 1-acetylamino-8-hydroxynaphthalene-4,6-disulfonic acid, 1-benzoylamino-8-hydroxynaphthalene-4,6-disulfonic acid, 1-acetylamino-5-hydroxynaphthalene-7-sulfonic acid, 2-methylamino-8-hydroxynaphthalene-6-sulfonic acid, 2-methylamino-8-hydroxynaphthalene-6-sulfonic acid and 2-(3'- or 4'-hydroxysulfonylphenyl)amino-8-hydroxynaphthalene-6-sulfonic acid.

$K^2$ may also be for example a pyrazolone, such as 1-phenyl-, 1-(2'-chlorophenyl)-, 1-(2'-methoxyphenyl)-, 1-(2'-methylphenyl)-, 1-(1',5'-dichlorophenyl)-, 1-(2',6'-dichlorophenyl)-, 1-(2'-methyl-6'-chlorophenyl)-, 1-(2'-methoxy-5'-methylphenyl)-, 1-(2'-methoxy-5'-hydroxysulfonylphenyl)-, 1-(2',5'-dihydroxysulfonylphenyl) -, 1-(2'-carboxyphenyl)-, 1-(3-hydroxysulfonylphenyl)-, 1-(4'-hydroxysulfonylphenyl)- or 1-(3'-sulfamoylphenyl)-3-carboxylpyrazol-5-one, 1-(3'- or 4'-hydroxysulfonylphenyl) -, 1-(2'-chloro-4'- or -5'-hydroxysulfonylphenyl)-, 1-(2'-methyl-4'-hydroxysulfonylphenyl)-, 1-(2',5'-dichlorophenyl)-, 1-(4',8'-dihydroxysulfonyl-1-naphthyl)- or 1-(6'-hydroxysulfonyl-1-naphthylyl)-3-methylpyrazol-5-one, ethyl 1-phenylpyrazol-5-one-3-carboxylate, ethyl pyrazol-5-one-3carboxylate and pyrazol-5-one-3-carboxylic acid.

$K^2$ may also be for example an aminopyrazole, such as 1-methyl-, 1-ethyl-, 1-propyl-, 1-butyl-, 1-cyclohexyl-, 1-benzyl- or 1-phenyl-5-aminopyrazole, 1-(4-chlorophenyl)- or 1-(4-methylphenyl)-5-aminopyrazole and 1-phenyl-3-methyl-5-aminopyrazole.

$K^2$ may also be for example a pyridone, such as 1-ethyl-2-hydroxy-4-methyl-5-carbamoylpyrid-6-one, 1-(2'-hydroxyethyl)-2-hydroxy-4-methyl-5-carbamoylpyrid-6-one, 1-phenyl-2-hydroxy-4-methyl-5-carbamoylpyrid-6-one, 1-ethyl-2-hydroxy-4-methyl-5-cyanopyrid-6-one, 1-ethyl-2-hydroxy-4-methyl-5-hydroxysulfonylmethylpyrid-6-one, 1-methyl-2-hydroxy-4-methyl-5-cyanopyrid-6-one, 1-methyl-2-hydroxy-5-acetylpyrid-6-one, 1,4-dimethyl-2-hydroxy-5-cyanopyrid-6-one, 1,4-dimethyl-5-carbamoylpyrid-6-one, 2,6-dihydroxy-4-ethyl-5-cyanopyridine, 2,6-dihydroxy-4-ethyl-5-carbamoylpyridine, 1-ethyl-2-hydroxy-4-methyl-5-hydroxysulfonylmethylpyrid-6-one, 1-methyl-2-hydroxy-4-methyl-5-methylsulfonylpyrid-6-one and 1-carboxymethyl-2-hydroxy-4-ethyl-5-phenylsulfonylpyrid-6-one.

Instead of the azo dyes of the formula IIc the process of the invention may also employ the corresponding metal complex dyes.

Suitable complexing metals here are in particular copper, cobalt, chromium, nickel and iron of which copper, cobalt and chromium are preferred. Of particular suitability are the symmetrical or asymmetrical 1:1 or 1:2 chromium complexes. The metallized groups are each preferably ortho to the azo group, for example in the form of o,o-dihydroxy-, o-hydroxy-o'-carboxy-, o-carboxy-o'-amino- or o-hydroxy-o'-amino-azo-groups.

Preference is given to dyes of formula IIc where $D^2$ is a radical of the formula XIIa, XIIb, XIIc, XIId, XIIe or XIIf where $U^1$ is hydrogen, methyl, methoxy, carboxyl, hydroxysulfonyl, hydroxyl or chlorine, $U^2$ is hydrogen, methyl, methoxy, carboxyl, hydroxysulfonyl, acetylamino or chlorine and $U^3$ is —CO—, —$SO_2$—, —CH=CH—, —$CH_2$–$CH_2$—, —$CH_2$— or —N=N—.

Preference is further given to dyes of formula IIc where the radical $K^2$ is derived from coupling components which have sulfo and/or carboxyl groups and which couple ortho or para to a hydroxyl and/or amino group.

Specific examples of such coupling components are 2-acetylamino-5-hydroxynaphthalene-7-sulfonic acid, 2-acetylamino-8-hydroxynaphthalene-6-sulfonic acid, 1-acetylamino-8-hydroxynaphthalene-3,6-disulfonic acid, 1-benzoylamino-8-hydroxynaphthalene-3,6-disulfonic acid, 1-acetylamino-8-hydroxynaphthalene-4,6-disulfonic acid or 1-benzoylamino-8-hydroxynaphthalene-4,6-disulfonic acid.

Preference is given to azo dyes of the formula XIV

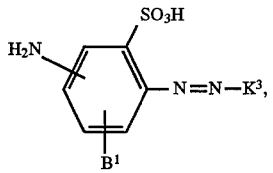

(XIV)

where $B^1$ is hydrogen, $C_1$–$C_4$-alkyl, $C_1$–$C_4$-alkoxy, chlorine or hydroxysulfonyl and $K^3$ is the radical of a coupling component of the naphthalene, pyrazolone or pyridone series.

Particular preference is further given to azo dyes of the formula XV

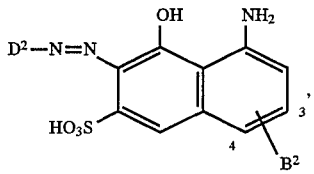

(XV)

where $D^2$ is as defined above and $B^2$ is hydroxysulfonyl in ring position 3 or 4.

Particular preference is further given to azo dyes of the formula XVI

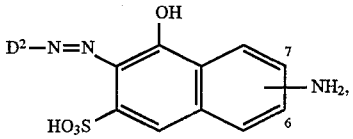

(XVI)

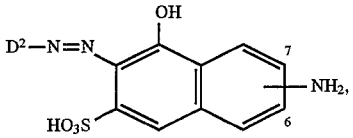

(XVI)

where $D^2$ is as defined above and the amino group is in ring position 6 or 7.

Useful compounds further include those of the formula XVII

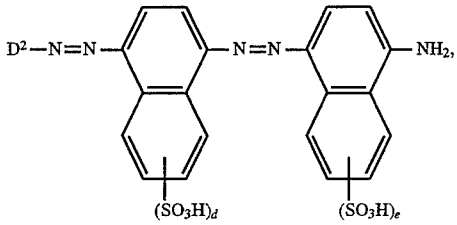

(XVII)

where $D^2$ is as defined above and d and e independently of each other are 0, 1 or 2.

Useful compounds further include those of the formula XVIII

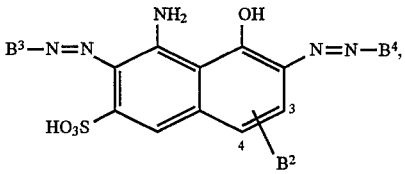

(XVIII)

where $B^2$ is as defined above and one of $B^3$ and $B^4$ is $D^2$, which has the abovementioned meaning, and the other is 3-amino-6-hydroxysulfonylphenyl or else both $B^3$ and $B^4$ are 3-amino-6-hydroxysulfonylphenyl.

Also of particular suitability is the symmetrical 1:2 chromium complex dye based on the azo dye 1-(2-hydroxy-4-hydroxysulfonyl-6-nitronaphth-1-ylazo)-2-hydroxynaphthalene.

Azo dyes having acid groups and metal complex dyes are described for example in K. Venkataraman, The Chemistry of Synthetic Dyes, Vol. III, Academic Press, New York, London, 1970.

The process of the present invention may also employ acid anthraquinone dyes. Such anthraquinone dyes are known per se and described for example in K. Venkataraman, The Chemistry of Synthetic Dyes, Vol. II, Academic Press, New York, 1952.

Preference is given to acid anthraquinone dyes of the series of the 1,4-diaminoanthraquinones. They conform for example to the formula XVIII

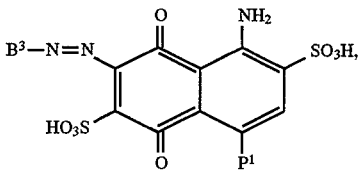

(XVIII)

where $p^1$ is amino or a radical of formula

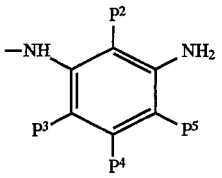

where $p^2$ and $p^3$ are independently of each other hydrogen or methyl and one of $p^4$ and $p^5$ is hydrogen or methyl and the other is hydroxysulfonyl.

The process of the present invention is carried out in aqueous liquor at a temperature of 20° to 250° C.

In the case of dyes of the class of the azo, anthraquinone, coumarin, methine or azamethine, quinophthalone or nitro dyes which are free of ionic groups, the novel process is preferably carried out at a temperature from 60° to 150° C., in particular 90° to 140° C., the range from 120° to 135° C. being particularly preferred. The pH ranges from 1 to 12, preferably from 2 to 10, in particular from 3 to 5 or 9 to 10, the range from 9 to 10 being particularly preferred. The pH range from 3 to 5 is used for all the nonionic dyes mentioned. The pH range from 9 to 10 can be used in particular for the dyes of the class of the anthraquinones, quinophthalones or alkali-stable azo dyes.

In the case of dyes with carboxyl and/or sulfo groups in the molecule, in particular acid azo or anthraquinone dyes, the novel process is preferably carried out at a temperature from 100° to 140° C., in particular from 120° to 140° C. The pH ranges from 2 to 5, preferably from 2 to 3.

Based on the weight of the condensation products to be dyed in the form of fibers, yarns, threads, wovens or knits or nonwovens, the amount of dye used is generally from 0.05 to 20% by weight, preferably from 0.5 to 10% by weight, in particular from 1 to 5% by weight.

The process of the present invention is advantageously carried out by introducing the material to be dyed at room temperature into a dyebath containing the dye or a combination of the above-mentioned dyes in the abovementioned amount and then heating the bath over a period from 30 to 60 minutes to the abovementioned temperature. The bath is then left at that temperature for from 30 to 180 minutes, preferably from 60 to 120 minutes, and then cooled back down to room temperature. If acid dyes are used, the dyebath may additionally contain from 5 to 10% by weight, based on the weight of the material to be dyed, of Glauber salt.

In the case of dyes which are free of ionic groups the material is then removed, washed, if necessary subjected to a conventional reductive aftertreatment (for example with sodium dithionite) and dried.

In the case of dyes which are free of ionic groups, the dyebath may additionally contain conventional dyeing assistants, for example dispersants based on the ligninsulfonates or condensation products of naphthalenesulfonic acid with formaldehyde, or organic solvents, such as benzaldehyde, benzyl alcohol or organic halogen compounds, for example chlorobenzene (carrier process).

Based on the liquor ratio, the concentration of these assistants ranges generally from 0 to 100 g/l, preferably from 20 to 70 g/l.

The novel process provides a simple way of dyeing the condensation products defined at the beginning. The dyeings obtained have good use fastness properties.

The Examples which follow illustrate the invention.

A1) Method for applying nonionic dyes in the acid range 10 g of a woven fabric produced from fibers of condensation products whose preparation is described in Example 3b of U.S. Pat No. 5,322,915 were introduced at a temperature of 80° C. into 200 ml of a dyeing liquor which contained 3% by weight, on weight of fiber, of dye and 0.5 g/l, based on the liquor ratio, of dispersant and whose pH had been adjusted to 3.5 with acetic acid. After 5 min at 80° C. the temperature was raised to 135° C. over 30 minutes, held at that level for 60 min and then cooled down to 60° C. over 40 min. Thereafter the dyed fabric was reduction cleared by treating it for 15 min in 200 ml of liquor containing 6 ml/l of 32% strength by weight sodium hydroxide solution, 3 g/l of sodium dithionite and 1 g/l of an ethoxylation product of a vegetable oil (nonionic). Finally the fabric was rinsed and dried.

A2) Method as per A1 but with the addition of 50 g of benzyl alcohol

B1) Method for applying nonionic dyes in the alkali range 10 g of a woven fabric produced from fibers of condensation products whose preparation is described in Example 3b of U.S. Pat. No. 5,322,915 were introduced at a temperature of 80° C. into 200 ml of a dyeing liquor which contained 4% by weight, on weight of fiber, of dye and whose pH had been adjusted to 10 with sodium hydroxide solution. After 5 min at 80° C. the temperature was raised to 135° C. over 40 minutes, held at that level for 180 min and then cooled down to 60° C. over 30 min. Thereafter the dyed fabric was reduction cleared by treating it for 15 min in 200 ml of liquor containing 6 ml/l of 32% strength by weight sodium hydroxide solution, 3 g/l of sodium dithionite and 1 g/l of an ethoxylation product of a vegetable oil (nonionic). Finally the fabric was rinsed and dried.

B2) Method as B1 but with the addition of 50 g/l of benzyl alcohol

C1) Method for applying dyes having sulfo and/or carboxyl groups 10 g of a woven fabric produced from fibers of condensation products whose preparation is described in Example 3b of U.S. Pat. No. 5,322,915 were introduced at a temperature of 80° C. into 150 ml of a dyeing liquor containing 3.3% by weight, on weight of fiber, of dye, 12 ml/l of 60% strength by weight aqueous acetic acid and also 5% by weight, on weight of fiber, of Glauber salt. After 5 min at 80° C. the temperature was raised to 135° C., held at that level for 60 min and then cooled back down to 70° C. over 40 min. Thereafter the fabric was rinsed and dried, complete exhaustion being obtained.

C2) Method as per C1 but with the addition of 50 g/l of benzyl alcohol

The dyeing methods can be applied not just to wovens but also for example to fibers, yarns, threads, knits or nonwovens.

The following dyes were used:

Dye 1

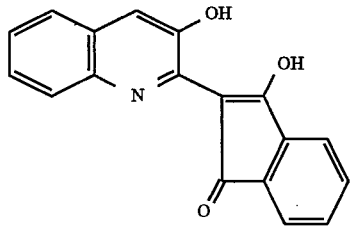

Dye 2
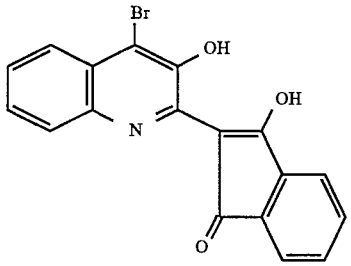
Dye 3
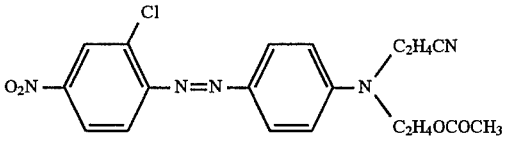
Dye 4
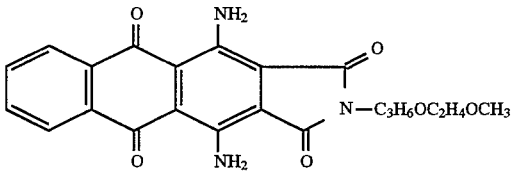
Dye 5
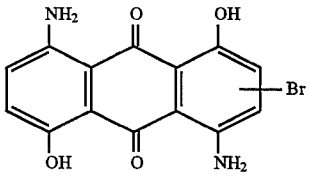
Dye 6
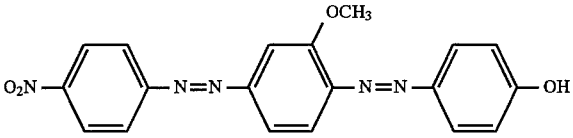
Dye 7
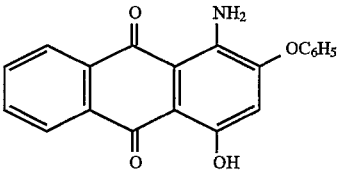
Dye 8
Mixture of
50% by weight of
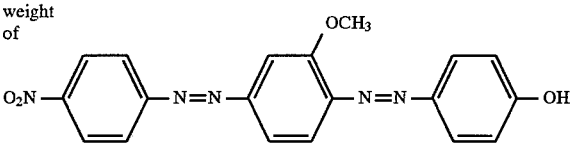
25% by weight of
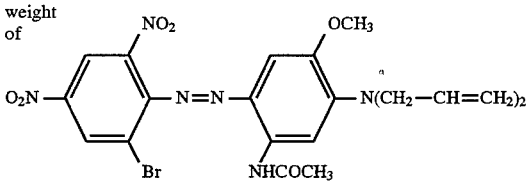
and
25% by weight of
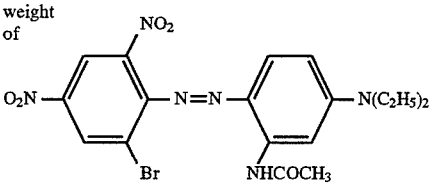

Dye 9

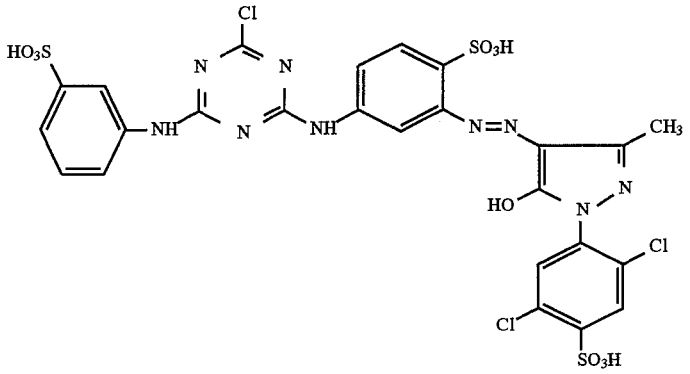

Dye 10

1:2 chromium complex of

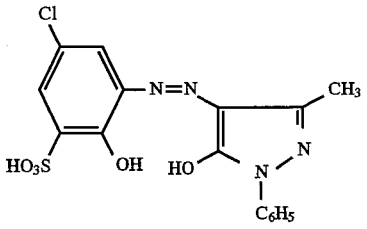

Dye 11

1:2 chromium/nickel complex of

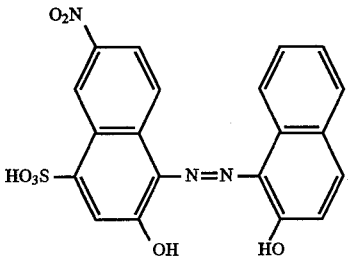

and

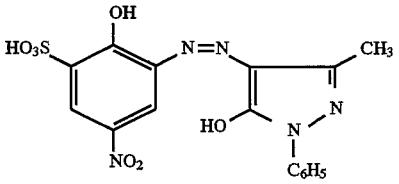

Dye 12

1:2 chromium complex of

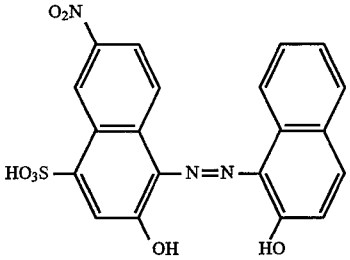

The table below additionally indicates the respective dyeing method and the resulting hue.

| Ex. No. | Dye No. | Dyeing method | Hue |
|---|---|---|---|
| 1 | 1 | A1 | yellow |
| 2 | 1 | A2 | yellow |
| 3 | 1 | B1 | yellow |
| 4 | 1 | B2 | yellow |
| 5 | 2 | A1 | yellow |
| 6 | 2 | A2 | yellow |
| 7 | 2 | B1 | yellow |
| 8 | 2 | B2 | yellow |
| 9 | 3 | A1 | red |
| 10 | 3 | A2 | red |
| 11 | 3 | B1 | red |
| 12 | 3 | B2 | red |
| 13 | 4 | A1 | turquoise |
| 14 | 4 | A2 | turquoise |
| 15 | 4 | B1 | turquoise |
| 16 | 4 | B2 | turquoise |
| 17 | 5 | A1 | blue |
| 18 | 5 | A2 | blue |
| 19 | 5 | B1 | blue |
| 20 | 5 | B2 | blue |
| 21 | 6 | A1 | orange |
| 22 | 6 | A2 | orange |
| 23 | 6 | B1 | orange |
| 24 | 6 | B2 | orange |
| 25 | 7 | A1 | red |
| 26 | 7 | A2 | red |
| 27 | 7 | B1 | red |
| 28 | 7 | B2 | red |
| 29 | 8 | A1 | black |
| 30 | 8 | A2 | black |
| 31 | 8 | B1 | black |
| 32 | 8 | B2 | black |
| 33 | 9 | C1 | yellow |
| 34 | 9 | C2 | yellow |
| 35 | 10 | C1 | red |

-continued

| Ex. No. | Dye No. | Dyeing method | Hue |
|---|---|---|---|
| 36 | 10 | C2 | red |
| 37 | 11 | C1 | brown |
| 38 | 11 | C2 | brown |
| 39 | 12 | C1 | black |
| 40 | 12 | C2 | black |

We claim:

1. A process for dyeing condensation products obtainable by condensation of a mixture including as essential components (A) from 90 to 99.9 mol % of a mixture consisting essentially of (a) from 30 to 99 mol % of melamine and (b) from 1 to 70 mol % of a substituted melamine of the formula I

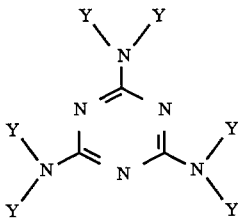

(I)

where each Y is independently of the others hydrogen, hydroxy-$C_2$–$C_{10}$-alkyl, hydroxy-$C_2$–$C_4$-alkyl-(oxa-$C_2$–$C_4$-alkyl)$_n$, where n is from 1 to 5, or amino-$C_2$–$C_{12}$-alkyl, with the proviso that at least one Y is not hydrogen, or mixtures of melamines of the formula I, and also (B) from 0.1 to 10 mol %, based on (A) plus (B), of phenol, which is optionally $C_1$–$C_9$-alkyl or hydroxy-substituted, $C_1$–$C_4$-alkanes which are hydroxyphenyl-substituted, bis(hydroxyphenyl) sulfones or mixtures thereof, with formaldehyde or formaldehyde donor compounds in a molar ratio of melamines to formaldehyde within the range from 1:1.15 to 1:4.5, which comprises treating the condensation products in the form of fibers, yarns, threads, wovens, knits or nonwovens in an aqueous liquor which has a pH from 1 to 12 at a temperature from 20° to 250° C. with one or more dyes of the class of the azo dyes, anthraquinone dyes, coumarin dyes, methine or azamethine dyes, quinophthalone dyes or nitro dyes, said dyes being free of ionic groups.

2. A process as claimed in claim 1 wherein the condensation products are treated with one or more monoazo or disazo dyes which are free of ionic groups and whose diazo component is derived from an aniline or from a five-membered aromatic heterocyclic amine which has from one to three hetero atoms selected from the group consisting of nitrogen, oxygen and sulfur in the heterocyclic ring and may be fused with a benzene, thiophene, pyridine or pyrimidine ring.

3. A process as claimed in claim 1 wherein the condensation products are treated with one or more anthraquinone dyes which are free of ionic groups and come from the class of the 1-aminoanthraquinones.

4. A process as claimed in claim 1 wherein the condensation products are treated with one or more coumarin dyes which are free of ionic groups and come from the class of the 7-dialkylaminocoumarins.

5. A process as claimed in claim 1 wherein the condensation products are treated with one or more methine or azamethine dyes which are free of ionic groups and come from the class of the triazolopyridines or pyridones.

6. A process as claimed in claim 1 wherein the condensation products are treated with one or more quinophthalone dyes which are free of ionic groups and are either unsubstituted or halogen-substituted in ring position 4 of the quinoline ring.

7. A process as claimed in claim 1 wherein from 0.01 to 20% by weight of dye is used, based on the weight of the condensation products to be dyed.

8. A process as claimed in claim 1 wherein the dyeing is carried out in the presence of from 0 to 100 g/l, based on the dyeing liquor, of an organic solvent.

* * * * *